US006008180A

United States Patent [19]

Drapier et al.

[11] Patent Number: 6,008,180

[45] **Date of Patent: *Dec. 28, 1999**

[54] MICROEMULSION LIGHT DUTY LIQUID CLEANING COMPOSITIONS

[75] Inventors: Julien Drapier, Seraing; Maria Galvez, Grace Hollogne; Nicole Kerzmann, Liege, all of Belgium; Gary Jakubicki, Robbinsville, N.J.

[73] Assignee: Colgate-Palmolive Co., Piscataway, N.J.

[ * ] Notice: This patent is subject to a terminal disclaimer.

[21] Appl. No.: 09/138,468

[22] Filed: Aug. 21, 1998

Related U.S. Application Data

[63] Continuation-in-part of application No. 08/714,435, Sep. 16, 1996, abandoned, which is a continuation-in-part of application No. 08/526,785, Sep. 11, 1995, Pat. No. 5,580,848, which is a continuation-in-part of application No. 08/356,615, Dec. 15, 1994, Pat. No. 5,529,723.

[51] Int. Cl.[6] ..... C11D 1/29; C11D 1/90; C11D 1/94; C11D 3/16

[52] U.S. Cl. ..... 510/417; 510/423; 510/425; 510/428; 510/432; 510/433; 510/503; 510/424; 510/470

[58] Field of Search ..... 510/417, 423, 510/424, 425, 428, 433, 470, 503, 432

[56] References Cited

U.S. PATENT DOCUMENTS

| | | | |
|---|---|---|---|
| 5,529,723 | 6/1996 | Drapier | 510/417 |
| 5,580,848 | 12/1996 | Drapier | 510/417 |
| 5,665,689 | 9/1997 | Durbut | 510/35 |

*Primary Examiner*—Yogendra Gupta
*Assistant Examiner*—Gregory R. Delcotto
*Attorney, Agent, or Firm*—Richard E. Nanfeldt

[57] ABSTRACT

A microemulsion light duty liquid detergent with desirable cleansing properties and mildness to the human skin comprising: a $C_{8-18}$ ethoxylated alkyl ether sulfate anionic surfactant, a sulfonate anionic surfactant, an alkyl polyglucoside surfactant, and a betaine surfactant and/or amine oxide surfactant, a cosurfactant, a water insoluble hydrocarbon, essential oil or perfume, water and optionally a $C_{8-18}$ mono or dialkoxylated alkylamide.

5 Claims, No Drawings

MICROEMULSION LIGHT DUTY LIQUID CLEANING COMPOSITIONS

RELATED APPLICATION

This application is a continuation in part of U.S. Ser. No. 8/714,435 filed Sep. 16, 1996, now abandoned, which in turn is a continuation in part application of U.S. Ser. No. 8/526,785 filed Sep. 11, 1995 now U.S. Pat. No. 5,580,848, which in turn is a continuation in part application of U.S. Ser. No. 8/356,615 filed Dec. 15, 1994 now U.S. Pat. No. 5,629,723.

FIELD OF INVENTION

This invention relates to a light duty liquid cleaning composition which imparts mildness to the skin and is in the form of a microemulsion designed in particular for cleaning hard surfaces and which is effective in removing grease soil and/or bath soil and in leaving unrinsed surfaces with a shiny appearance.

BACKGROUND OF THE INVENTION

In recent years all-purpose liquid detergents have become widely accepted for cleaning hard surfaces, e.g., painted woodwork and panels, tiled walls, wash bowls. bathtubs, linoleum or tile floors, washable wall paper, etc.. Such all-purpose liquids comprise clear and opaque aqueous mixtures of water-soluble organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319: and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616 —Herbots et al; European Patent Application EP 0160762 - Johnston et al; and U.S. Pat. No. 4,561,991 —Herbots et al. Each of these patent disclosures also teaches using at least 5% by weight of grease-removal solvent.

It also is known from British Patent Application GB 2144763A to Herbots et al. published Mar. 13, 1985, that magnesium salts enhance grease-removal performance of organic grease-removal solvents, such as the terpenes. in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. Nos. 4,472,291 —Rosario; 4,540,448 —Gauteer et al: 3,723,330 —Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749: British Patent Specification 1,603,047; 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) lying in the range Vf 5:1 to 1:3; and (c ) from about 0.5% about 10% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotropes, e.g., urea, ethanolamines, salts of lower alkylaryl sulfonates, up to about 10% by weight. All of the formulations shown in the Examples of this patent include relatively large amounts of detergent builder salts which are detrimental to surface shine.

U.S. Pat. No. 5,082,584 discloses a microemulsion composition having an anionic surfactant, a cosurfactant, nonionic surfactant, perfume and water; however, these compositions are not light duty liquid compositions.

The present invention relates to novel microemulsion light duty liquid detergent compositions with high foaming properties, containing an alkyl polyglucoside surfactant, a sulfonate surfactant, a betaine and/or amine oxide surfactant, an ethoxylated alkyl ether sulfate surfactant, and optionally a cosurfactant, a solubilizing agent and/or an alkyl mono or dialkoxylated amide.

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major active ingredient. Yet, little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,671,895 teaches a liquid detergent composition containing an alcohol sulfate surfactant, a nonionic surfactant, a paraffin sulfonate surfactant, an alkyl ether sulfate surfactant and water but fails to disclose an alkyl polysaccharide surfactant.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monethanolamide foam stabilizer.

However, none of the above-cited patents discloses a microemulsion foaming, liquid detergent composition containing a nonionic surfactant, a supplementary high foaming anionic sulfonate surfactant, a betaine surfactant, and an ethoxylated alkyl ether sulfate surfactant and a water insoluble hydrocarbon or perfume as the essential ingredients, and the composition does not contain any abrasives, silicas, alkaline earth metal carbonates, alkyl glycine surfactant, cyclic imidinium surfactant, alkali metal carbonates or more than 3 wt. % of a fatty acid or its salt thereof.

SUMMARY OF THE INVENTION

It has now been found that a microemulsion light duty liquid detergent can be formulated with a nonionic surfactant which has desirable cleaning properties, and mildness to the human skin.

An object of this invention is to provide a novel microemulsion light duty liquid detergent composition containing, a betaine surfactant and/or an amine oxide surfactant, a sulfonate anionic surfactant, an ethoxylated alkyl ether sulfate surfactant. a cosurfactant, an alkyl polyglucoside surfactant, a water insoluble hydrocarbon, essential oil or perfume and water, plus optionally, a solubilizing agent and/or an alkyl mono or dialkoxylated amide, wherein the composition does not contain any silicas. abrasives, alkali metal carbonates, alkaline earth metal carbonates, alkyl glycine surfactant, cyclic imidinium surfactant, or more than 3 wt. % of a fatty acid or salt thereof.

Another object of this invention is to provide a novel microemulsion light duty liquid detergent with desirable high foaming and cleaning properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the novel, high foaming microemulsion light duty liquid detergent of this invention comprises: a water soluble, ethoxylated, nonionic surfactant, a betaine surfactant and/or an amine oxide surfactant, an ethoxylated alkyl ether sulfate surfactant, a sulfate or sulfonate anionic surfactant, a cosurfactant, an alkyl polyglucoside surfactant, a water insoluble hydrocarbon, essential oil or perfume, optionally, a solubilizing agent and water, wherein the composition does not contain any silicas, abrasives, alkali metal carbonates, alkaline earth metal carbonates. alkyl glycine surfactant, cyclic imidinium surfactant or more than 3 wt. % of a fatty acid or salt thereof.

DETAILED DESCRIPTION OF THE INVENTION

The microemulsion light duty liquid compositions of the instant invention comprise approximately by weight:

(a) 2% to 15% of a metal salt of a sulfonate anionic surfactant;

(b) 2% to 15% of an alkali metal salt of a $C_{8-18}$ ethoxylated alkyl ether sulfate;

(c) 1% to 12% of a betaine surfactant and/or an amine oxide surfactant;

(d) 0 to 12% of at least one solubilizing agent;

(e) 1 % to 12% of an alkyl polyglucoside surfactant;

(f) 0 to 10% of a supplemental solubilizing agent;

(g) 1 % to 8% of a water insoluble saturated or unsaturated organic compound having 4 to 30 carbon atoms which can be a mixture of perfumes, water insoluble hydrocarbons or essential oils and mixture thereof;

(h) 1% to 14% of a at least one cosurfactant;

(i) 0% to 6% of a $C_{8-18}$ mono- or dialkoxylated alkylamide;

(j) the balance being water.

The instant compositions contain about 1 wt. % to about 12 wt. %, more preferably 2 wt. % to 10 wt. % of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl dodecyl, tetradecyl, pentadecyl, hexadecyl, and octadecyl, di-, tri-, tetra-, penta-. and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$RO(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3, preferably 2, r is from 0 to 10, preferably 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG625™ glycoside manufactured by the Henkel Corporation of Ambler, Pa. APG625™ is a nonionic alkyl polyglycoside characterized by the formula:

$$C_nH_{2n+1}O(C_6H_{10}O_5)_xH$$

wherein n=10 (2%); n=12 (65%); n=14 (21–28%); n=16 (4–8%) and n=18 (0.5%) and x (degree of polymerization)= 1.6. APG 625™ has: a pH of 6 to 10 (10% of APG 625™ in distilled water); a specific gravity at 25° C. of 1.1 g/ml; a density at 25° C. of 9.1 lbs/gallon; a calculated HLB of 12.1 and a Brookfield viscosity at 35° C., 2 spindle, 5–10 RPM of 3,000 to 7,000 cps.

The anionic sulfonate surfactants which may be used in the detergent of this invention are water soluble and include the sodium, potassium, ammonium, magnesium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates and mixtures thereof. The preferred anionic sulfonate surfactants are a paraffin sulfonate or alkyl benzene sulfonate present in the composition at a concentration of about 2% to 15 wt. %, more preferably 4% to 13 wt.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly- sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants have the structure $$R—(OCHCH_2)_nOSO_3^-M^+$$

wherein n is about 1 to about 22, more preferably 1 to 3, and R is an alkyl group having about 8 to about 18 carbon atoms, more preferably 12 to 15, and natural cuts, for example, $C_{12-14}$ or $C_{12-16}$ and M is an ammonium cation or a metal cation, most preferably sodium. The ethoxylated alkyl ether sulfate is present in the composition at a concentration of about 2 to about 15 wt. %, more preferably about 3 to 12 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof.

Ethoxylated $C_{8-18}$ alkylphenyl ether sulfates containing from 1 to 6 moles of ethylene oxide in the molecule are also suitable for use in the inventive compositions. These detergents can be prepared by reacting an alkyl phenol with 1 to 6 moles of ethylene oxide and sulfating and neutralizing the resultant ethoxylated alkylphenol. The concentration of the ethoxylated alkyl ether sulfate surfactant is about 2 to about 15 wt. %.

The instant composition contains about 1 to about 12 wt. %, more preferably about 3 to about 10 wt. %, more preferably 3 to 9 wt. % of a zwitterionic surfactant and/or an amine oxide surfactant. The zwitterionic surfactant is a water soluble betaine having the general formula:

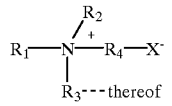

wherein $X^-$ is selected from the group consisting of $SO_3$— and $CO_2$— and $R_1$ is an alkyl group having 10 to about 20 carbon atoms, preferably 12 to 16 carbon atoms, or the amido radical:

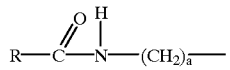

wherein R is an alkyl group having about 9 to 19 carbon atoms and a is the integer 1 to 4; $R_2$ and $R_3$ are each alkyl groups having 1 to 3 carbons and preferably 1 carbon, $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. Preferred betaines are coco ($C_8$–$C_{18}$) amidopropyl dimethyl betaine and lauryl dimethyl betaine.

The amine oxides are semi-polar nonionic surfactants which comprise compounds and mixtures of compounds having the formula

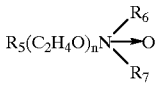

wherein $R_5$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_6$ and $R_7$ are each methyl, ethyl, propyl, isopropyl, 2-hydroxyethyl, 2-hydroxypropyl, or 3-hydroxypropyl, are from 0 to 10. Particularly preferred are amine oxides of the formula:

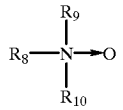

wherein $R_8$ is a $C_{12-16}$ alkyl group or amido radical:

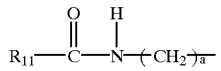

wherein $R_{11}$ is an alkyl group having about 9 to 19 carbon atoms and a is an integer 1 to 4 and $R_9$ and $R_{10}$ are methyl or ethyl. The above ethylene oxide condensates, amides, and amine oxides are more fully described in U.S. Pat. No. 4,316,824 which is hereby incorporated herein by reference.

The water insoluble saturated or unsaturated organic compounds contain 4 to 30 carbon atoms and up to 4 different or identical functional groups and is used at a concentration of about 1.0 wt. % to about 8 wt. %, more preferably about 2.0 wt. % to about 7 wt. %. Examples of acceptable water insoluble saturated or unsaturated organic compounds include (but are not limited to) water insoluble hydrocarbons containing 0 to 4 different or identical functional groups, water insoluble aromatic hydrocarbons containing 0 to 4 different or identical functional groups, water insoluble heterocyclic compounds containing 0 to 4 different or identical functional groups, water insoluble ethers containing 0 to 3 different or identical functional groups, water insoluble alcohols containing 0 to 3 different or identical functional groups, water insoluble amines containing 0 to 3 different or identical functional groups, water insoluble esters containing 0 to 3 different or identical functional groups, water insoluble carboxylic acids containing 0 to 3 different or identical functional groups, water insoluble amides containing 0 to 3 different or identical functional groups, water insoluble nitrites containing 0 to 3 different or identical functional group, water insoluble aldehydes containing 0 to 3 different or identical functional groups, water insoluble ketones containing 0 to 3 different or identical functional groups, water insoluble phenols containing 0 to 3 different or identical functional groups, water insoluble nitro compounds containing 0 to 3 different or identical functional groups, water insoluble halogens containing 0 to 3 different or identical functional groups, water insoluble sulfates or sulfonates containing 0 to 3 different or identical functional groups, limonene, dipentene, terpineol, essential oils, perfumes, water insoluble organic compounds containing up to 4 different or identical functional groups such as an alkyl cyclohexane having both three hydroxys and one ester group and mixture thereof.

Typical heterocyclic compounds are 2,5-dimethylhydrofuran,2-methyl-1,3-dioxolane, 2-ethyl 2-methyl 1,3 dioxolane, 3-ethyl 4-propyl tetrahydropyran, 3-morpholino-1,2-propanediol and N-isopropyl morpholine. A typical amine is alphamethyl benzyldimethylamine. Typical halogens are 4-bromotoluene, butyl chloroform and methyl perchloropropane. Typical hydrocarbons are 1,3-dimethylcyclohexane, cyclohexyl-1 decane, methyl-3 cyclohexyl-9 nonane, methyl-3 cyclohexyl-6 nonane, dimethyl cycloheptane, trimethyl cyclopentane, ethyl-2 isopropyl-4 cyclohexane. Typical aromatic hydrocarbons are bromotoluene, diethyl benzene, cyclohexyl bromoxylene, ethyl-3 pentyl-4 toluene, tetrahydronaphthalene, nitrobenzene and methyl naphthalene. Typical water insoluble esters are benzyl acetate, dicyclopentadienylacetate, isononyl acetate, isobornyl acetate, isobutyl isobutyrate and, alipathic esters having the formula of:

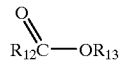

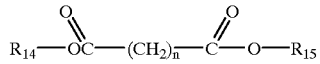

wherein $R_{12}$, $R_{14}$ and $R_{15}$ are $C_2$ to $C_8$ alkyl groups, more preferably $C_3$ to $C_7$ alkyl groups, and $R_{13}$ is a $C_3$ to $C_8$ alkyl group, more preferably $C_4$ to $C_7$ alkyl group, and n is a number from 3 to 8, more preferably 4 to 7.

Typical water insoluble ethers are di(alphamethyl benzyl) ether and diphenyl ether. Typical alcohols are phenoxyethanol and 3-morpholino-1,2-propanediol. Typical water insoluble nitro derivatives are nitro butane and nitrobenzene.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen, Allocimene, Arbanex™, Arbanol®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, Fernlol™, Florilys™, Geraniol, Geranyl Acetate, Geranyl Nitrile, Glidmint™ Mint oils, Glidox™, Grapefruit oils, trans-2-Hexenal, trans- 2-Hexenol, cis-3-Hexenyl Isovalerate, cis-3-Hexanyl-2-methylbutyrate, Hexyl Isovalerate, Hexyl-2-methylbutyrate, Hydroxycitronellal, Ionone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo lonone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, Tetralol®, Tomato oils, Vitalizair, and Zestoral™.

The instant compositions can contain about 0 to about 12 wt. %, more preferably about 1 % to about 10 wt. %, of at least one solubilizing agent which can be sodium xylene sulfonate, sodium cumene sulfonate, a $C_{2-5}$ mono, di or polyhydroxy alkanol such as ethanol, isopropanol, glycerol, ethyleneglycol, diethyleneglycol and propylene glycol and mixtures thereof. The solubilizing agents are included in order to control low temperature cloud clear properties. Urea can be optionally employed in the instant composition as a supplemental solubilizing agent at a concentration of 0 to about 10 wt. %, more preferably about 0.5 wt. % to about 8 wt. %.

Preferably the solubilizing ingredient will be a mixture of ethanol and a water soluble salt of a $C_{1-C3}$ substituted benzene sulfonate hydrotrope such as sodium xylene sulfonate or sodium cumene sulfonate or a mixture of said sulfonates or ethanol and urea. Inorganic alkali metal or alkaline earth metal salts such as sodium sulfate, magnesium sulfate, sodium chloride and sodium citrate can be added at concentrations of 0.5 to 6.0 wt. % to modify the cloud point of the nonionic surfactant and thereby control the haze of the resultant solution. Various other ingredients such as urea at a concentration of about 0.5 to 8.0 wt. % or urea at the same concentration in combination with ethanol at a concentration of about 0.5 to 8.0 wt. % can be used as solubilizing agents.

The instant composition can also contain a $C_{8-15}$ alkyl monoalkanol amide such as lauryl monoalkanol amide and/or a $C_{12-14}$ alkyl dialkanol amide such as lauryl diethanol amide or coco diethanol amide wherein the concentration of the mono- and/or di-alkanol amide is about 0 to about 6 wt. %, more preferably about 1 wt. % to about 5 wt. %. The instant composition can also contain about 0 wt. % to about 6 wt. %, more preferably about 0 wt. % to about 5 wt. % of an a $C_{8-18}$ alkyl mono or dialkoxylated amide which has amount 2 to about 8 alkoxylate groups such as PEG-6 lauramide or cocodiethanolamide 4.5 EO.

The cosurfactant may play an essential role in the formation of the dilute o/w microemulsion and the concentrated microemulsion compositions. Very briefly, in the absence of the cosurfactant the water, detergent(s) and hydrocarbon (e.g., perfume) will, when mixed in appropriate proportions form either a micellar solution (low concentration) or form an oil-in-water emulsion in the first aspect of the invention. With the cosurfactant added to this system, the interfacial tension at the interface between the emulsion droplets and aqueous phase is reduced to a very low value. This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized.

Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity. Generally, an increase in cosurfactant concentration results in a wider temperature range of the stability of the product.

The major class of compounds found to provide highly suitable cosurfactants for the microemulsion over temperature ranges extending from 5° C. to 43° C. for instance are water-soluble polyethylene glycols having a molecular weight of 150 to 1000, polypropylene glycol of the formula $HO(CH_3CHCH_2O)_nH$ wherein n is a number from 2 to 18, mixtures of polyethylene glycol and polypropylene glycol (Synalox) and mono and di $C_1$–$C_6$ alkyl ethers and esters of ethylene glycol and propylene glycol having the structural formulas $R(X)_nOH$, $R_1(X)_nOH$, $R(X)_nOR$, $R_1(X)_nOR_1$ and $R_1$ (X)nOR wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1methoxy-2-propanol, 1methoxy-3-propanol, and 1 methoxy 2-, 3- or 4-butanol.

Representative members of the polypropylene glycol include dipropylene glycol and polypropylene glycol having a molecular weight of 150 to 1000, e.g., polypropylene glycol 400. Other satisfactory glycol ethers are ethylene glycol monobutyl ether (Butyl Cellosolve™), diethylene glycol monobutyl ether (Butyl Carbitol™), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di, tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether, mono, di, tributylene glycol monohexyl ether, ethylene glycol monoacetate and dipropylene glycol propionate.

While all of the aforementioned glycol ether compounds provide the described stability, the most preferred cosurfactant compounds of each type, on the basis of cost and cosmetic appearance (particularly odor), are dipropylene glycol monomethyl ether and diethylene glycol monobutyl ether. Other suitable water soluble cosurfactants are water soluble esters such as ethyl lactate and water soluble carbohydrates such as butyl glycosides.

The amount of cosurfactant required to stabilize the microemulsion compositions will, of course, depend on such factors as the surface tension characteristics of the cosurfactant, the type and amounts of the primary surfactants and water insoluble hydrocarbon, and the type and amounts of any other additional ingredients which may be present in the composition and which have an influence on the thermodynamic factors enumerated above. Generally, amounts of cosurfactant in the range of from 1% to 14%, preferably from about 2 wt. % to 10 wt. %, provide stable dilute o/w microemulsions for the above-described levels of primary surfactants and water insoluble hydrocarbon and any other additional ingredients as described below.

In addition to the above-described essential ingredients required for the formation of the liquid crystal composition or the microemulsion composition, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate, magnesium hydroxide and MgLAS. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the pH of the system, the nature of the primary surfactants and cosurfactant, and so on, as well as the availability and cost factors, other suitable polyvalent metal ions include aluminum, copper, nickel, iron, calcium, etc. It should be noted, for example, that with the preferred paraffin sulfonate anionic detergent, calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions, as mentioned for the magnesium salts, can be used, such as halide (e.g., bromide, chloride), sulfate, nitrate, hydroxide, oxide, acetate, propionate, etc.

The proportion of the multivalent salt generally will be from 0 to about 6 wt. %, more preferably about 1 to about 5 wt. %.

The ability to formulate mild, acid or neutral products without builders which have grease removal capacities is a feature of the present invention because the prior art o/w microemulsion formulations most usually are highly alkaline or highly built or both.

The instant compositions contain 0.0005 wt. % to 0.4 wt. %, more preferably 0.0008 wt. % to 0.2 wt. % of a dye such as Orange 4, FD&C Green 8, Green Shade, Blue 1, Yellow I 0, External Violet 2, Yellow 6 or Acid Red 52 and mixtures thereof.

The instant microemulsion formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The final essential ingredient in the inventive microemulsion compositions having improved interfacial tension properties is water. The proportion of water in the microemulsion compositions generally is in the range of 35% to 65%, preferably 40% to 60% by weight, of the usual diluted o/w microemulsion composition.

In final form, the instant compositions exhibit stability at reduced and increased temperatures. More specifically, such compositions remain clear and stable in the range of 5° C. to 50° C., especially 10° C. to 43° C. Such compositions exhibit a pH of 5 to 8. The liquid microemulsion compositions are readily pourable and exhibit a viscosity in the range of 6 to 300 milliPascal. second (mPas.) as measured at 25° C. with a Brookfield RVT Viscometer using a #1 spindle rotating at 20 RPM. Preferably, the viscosity is maintained in the range of 10 to 200 mPas.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing the different ingredients with deionized water:

| | A | B | C | D |
|---|---|---|---|---|
| Magnesium $C_8$–$C_{18}$ linear alkyl benzene sulfonate | 6.5 | 6.5 | 7.7 | 7.7 |
| $C_8$–$C_{18}$ ethoxylated alkyl ether sulfate (AEOS 2EO) | — | — | — | — |
| $C_8$–$C_{18}$ ethoxylated alkyl ether sulfate (AEOS 1.3EO) | 7.35 | 7.35 | 9.9 | 9.9 |
| Sodium $C_8$–$C_{18}$ linear alkyl benzene sulfonate | 2.55 | 2.55 | 2.5 | 2.5 |
| Cocoamidopropyl dimethyl betaine | 5.1 | 5.1 | — | — |
| APG625 ™ | 8.5 | 8.5 | 8.5 | 8.5 |
| Cocodimethylamine oxide | — | — | — | — |
| Cocoamidopropyl dimethyl amine oxide | 3.2 | 3.2 | 5.4 | 5.4 |
| PEG-6 Lauramide | 0.8 | 0.8 | — | — |
| Limonene | 4.0 | 3.2 | 5.0 | 4.0 |
| Terpineol | — | 0.8 | — | 1.0 |
| Ethanol | 5.0 | 6.0 | 1.0 | 4.0 |
| Dipropylene glycol monomethyl ether | 6.0 | 6.0 | 6.0 | 6.0 |
| Urea | 5.0 | 5.0 | 5.0 | 5.0 |
| Water | | up to 100% | | |
| Appearance @ RT | ok | ok | ok | ok |
| Appearance @ 4 C. | ok | ok | ok | ok |
| Brookfield | 100 | 80 | 90 | 80 |
| Olive oil emulsification time versus PAIC Excel | 1.0 | 0.6 | 1.5 | 0.9 |
| Suds titration with Crisco (g) at 300 ppm | 3.5 | 3.6 | 4.7 | 4.1 |

EXAMPLE 2

The following compositions in wt. % were prepared by simple mixing the different ingredients with deionized water:

| | A | B | C | D | E | F | G | H | I |
|---|---|---|---|---|---|---|---|---|---|
| Magnesium $C_8$–$C_{18}$ linear alkyl benzene sulfonate | 6.50 | 6.50 | 6.50 | 6.50 | 6.50 | 7.7 | 7.7 | 7.7 | 7.7 |
| $C_8$–$C_{18}$ ethoxylated alkyl ether sulfate (AEOS 2EO) | | | | | | | | | |
| $C_8$–$C_{18}$ ethoxylated alkyl ether sultate (AEOS 1.3EO) | 7.35 | 7.35 | 7.35 | 7.35 | 7.35 | 9.9 | 9.9 | 9.9 | 9.9 |
| Nonionic $C_{11}$ alcohol EO 9:1 | | | | | | | | | |
| Nonionic $C_{9-11}$ EO 7.5–8:1 | | | | | | | | | |
| Lauryl alkyl dimethyl betaine | | | | | | | | | |
| Sodium $C_8$–$C_{18}$ linear alkyl benzene sulfonate | 2.55 | 2.55 | 2.55 | 2.55 | 2.55 | 2.5 | 2.5 | 2.5 | 2.5 |
| Cocoamidopropyl dimethyl betaine | 5.1 | 5.1 | 5.1 | 5.1 | 5.1 | | | | |
| APG625 | 8.5 | 8.5 | 8.5 | 8.5 | 8.5 | 8.5 | 8.5 | 8.5 | 8.5 |
| Coco dimethylamine oxide | | | | | | | | | |
| Cocoamidopropyl dimethyl amine oxide | 3.2 | 3.2 | 3.2 | 3.2 | 3.2 | 5.4 | 5.4 | 5.4 | 5.4 |
| PEG-6 Lauramide | 0.8 | 0.8 | 0.8 | 0.8 | 0.8 | | | | |
| MgSO4-7H2O | | | | | | | | | |
| Alpha Pinene | 4 | | | | | | | | |
| Isobutyl Isobutyrate | | 4 | | | | 4 | | | |
| Litsea Cubeda | | | 4 | | | | 4 | | |
| Nitrobenzene | | | | 4 | | | | | 4 |
| Butylbenzene | | | | | 4 | | | 4 | |
| Ethanol | 4 | 5 | 5 | 5 | 8 | 0 | 0 | 1 | 1 |
| Dipropylene glycol monomethyl ether | 6 | 6 | 6 | 6 | 6 | 6 | 6 | 6 | 6 |
| Urea | 5 | 5 | 5 | 5 | 5 | 5 | 5 | 5 | 5 |
| Water | | | | | up to 100% | | | | |
| Appearance @ RT | ok | ok | ok | ok | ok | ok | ok | ok | ok |
| Appearance @ 4° C. | ok | ok | ok | ok | ok | ok | ok | ok | ok |
| Brookfield | 150 | 90 | 100 | 80 | 60 | 140 | 200 | 100 | 115 |
| Olive oil emulsification time versus Paic Excel | 0.7 | 1.2 | 0.9 | 1.4 | 1.1 | 0.9 | 0.5 | 0.5 | 0.9 |
| Suds titration with Crisco (g) at 300 ppm | 4.2 | 3.2 | 4.2 | 3.0 | 2.8 | 3.8 | 3.4 | 3.8 | 4.0 |

EXAMPLE 3

The following compositions in wt. % were prepared by simple mixing the different ingredients with deionized water:

| | A | B | C |
|---|---|---|---|
| Magnesium $C_8$–$C_{18}$ linear alkyl benzene sulfonate | 7.7 | 7.7 | 7.7 |
| $C_8$–$C_{18}$ ethoxylated alkyl ether sulfate (AEOS 2EO) | | | |
| $C_8$–$C_{18}$ ethoxylated alkyl ether sulfate (AEOS 1.3EO) | 9.9 | 9.9 | 9.9 |
| Nonionic $C_{11}$ alcohol EO 9:1 | | | |
| Nonionic $C_{9-11}$ EO 7.5–8:1 | | | |
| Lauryl alkyl dimethyl betaine | | | |
| Sodium $C_8$–$C_{18}$ linear alkyl benzene sulfonate | 2.5 | 2.5 | 2.5 |
| Cocoamidopropyl dimethyl betaine | | | |
| APG625 | 8.5 | 8.5 | 8.5 |
| Coco dimethylamine oxide | | | |
| Cocoamidopropyl dimethyl amine oxide | 5.4 | 5.4 | 5.4 |
| PEG-6 Lauramide | | | |
| LMMEA/SXS blend (62/38) | | | |
| MgSO4.7H2O | | | |
| Limonene | | | |
| Alpha Pinene | | | |
| Isobutyl Isobutyrate | | | |
| Litsea Cubeda | | | |
| Nitrobenzene | 4 | 4 | 4 |
| 1,3 Dimetyl Cyclohexane | | | |
| Butylbenzene | | | |
| Ethanol | | | |
| Diethylene glycol monobutyl ether | 4 | | |
| Isopropyl Alcohol | | 3 | |
| PEG 400 | | | 3 |
| Dipropylene glycol monomethyl ether | 6 | 6 | 6 |
| Urea | 5 | 5 | 5 |
| Water | | up to 100 % | |
| Appearance @ RT | ok | ok | ok |
| Appearance @ 4° C. | ok | ok | ok |

-continued

| | A | B | C |
|---|---|---|---|
| Brookfield | 80 | 70 | 80 |
| Olive oil emulsification time versus Paic Excel | 1.1 | 1.3 | 1.0 |
| Suds titration with Crisco (g) at 300 ppm | 3.1 | 3.5 | 3.5 |

What is claimed:

1. A clear microemulsion light duty liquid cleaning composition which comprises approximately by weight:

(a) 2% to 15% of a metal salt of an anionic sulfonate surfactant;

(b) 2% to 15% of an alkali metal salt of a $C_{8-18}$ ethoxylated alkyl ether sulfate;

(c) 1% to 12% of a betaine surfactant and/or amine oxide surfactant;

(d) 1% to 12% of at least one solubilizing agent;

(e) 1% to 14% of at least one cosurfactant wherein said cosurfactant is selected from the group consisting of polyethylene glycols having a molecular weight of 150 to 1000, polypropylene glycol of the formula $HO(CH_3CHCH_2O)_nH$, wherein n is 2 to 18, mixtures of polyethylene glycol and polypropylene glycol, mono and di $C_1$–$C_6$ alkyl ethers and esters of ethylene glycol and propylene glycol having the formulas of $R(X)_nOH$ and $R_1(X)_nOH$, R(X)nOR,R1(X)nOR1 and R1(X)nOR wherein R is a $C_{1-6}$ alkyl group, $R_1$ is a $C_{2-4}$ acyl group, X is $(OCH_2CH_2)$ or $(OCH_2CHCH_3)$ and n is from 1 to 4;

(f) 0.5% to 10% of urea;

(g) 1% to 8% of water insoluble unsaturated or saturated organic compound wherein said organic compound is selected from the group consisting of water insoluble hydrocarbons having 4 to 30 carbon atoms, containing 0 to 4 different or identical functional groups water insoluble nitriles containing 0 to 3 different or identical functional groups, water insoluble aldehydes containing 0 to 3 different or identical functional groups, water insoluble ketones containing 0 to 3 different or identical functional groups, water insoluble phenols containing 0 to 3 different or identical functional groups and water insoluble nitro compounds containing 0 to 3 different or identical functional groups and mixtures thereof;

(h) 1% to 12% of an alkyl polyglucoside surfactant;

(i) 0.8 to 6% of a $C_{8-18}$ mono or dialkoxylated alkylamide; and (j) the balance being water.

2. The composition of claim 1, wherein said solubilizing agent is a $C_{2-5}$ mono, di or polyhydroxy alkanol.

3. The composition of claim 1, wherein said solubilizing agent is selected from the group consisting of isopropanol, ethanol, glycerol, ethyleneglycol, diethyleneglycol and propylene glycol and mixtures thereof.

4. The composition of claim 1, wherein cosurfactant is dipropylene glycol monomethyl ether.

5. The composition of claim 1, wherein said cosurfactant is diethylene glycol monobutyl ether.

* * * * *